US005590667A

United States Patent [19]

Wagner et al.

[11] Patent Number: 5,590,667

[45] Date of Patent: Jan. 7, 1997

[54] TOBACCO EXPANSION METHOD

[75] Inventors: John R. Wagner; J. E. Howard Smith, both of Greensboro, N.C.

[73] Assignee: SCW, Inc., Greensboro, N.C.

[21] Appl. No.: 508,441

[22] Filed: Jul. 28, 1995

[51] Int. Cl.[6] ..... A24B 3/18

[52] U.S. Cl. ..... 131/291; 131/901; 131/902

[58] Field of Search ..... 131/291, 296, 131/900, 901, 902

[56] References Cited

U.S. PATENT DOCUMENTS

| | | | |
|---|---|---|---|
| 1,789,435 | 1/1931 | Hawkins . | |
| 3,144,871 | 8/1964 | De Souza et al. . | |
| 3,524,451 | 8/1970 | Fredrickson . | |
| 3,524,452 | 8/1970 | Moser et al. . | |
| 3,753,440 | 8/1973 | Ashburn . | |
| 3,771,533 | 11/1973 | Armstrong et al. . | |
| 4,531,529 | 7/1985 | White et al. | 131/902 X |
| 4,641,665 | 2/1987 | Hedge et al. . | |
| 4,696,313 | 9/1987 | Brown et al. | 131/296 X |
| 5,065,774 | 11/1991 | Grubbs et al. . | |
| 5,469,872 | 11/1995 | Beard et al. | 131/291 |

FOREIGN PATENT DOCUMENTS

| | | | |
|---|---|---|---|
| 0680461 | 2/1964 | Canada | 131/291 |
| 3214172 | 9/1988 | Japan | 131/296 |
| 2293748 | 4/1996 | United Kingdom . | |

*Primary Examiner*—Jennifer Bahr

[57] ABSTRACT

A tobacco expansion method is provided whereby cured tobacco is first moistened with a humectant solution, as is conventional in the industry, to increase the resident liquids thereof. Next, the prepared tobacco in shredded form is placed in a sealed chamber and the chamber evacuated to vaporize a portion of the resident liquids. Next, ethyl alcohol vapor is allowed to enter the pressure chamber below 70 mm (Hg) absolute to prevent a water-ethyl alcohol azeotrope from forming. Thereafter, a hydrocarbon vapor, such as n-pentane vapor, is directed into the chamber and the pressure restored to atmospheric. The n-pentane vapor diffuses into the cellular structure of the tobacco with the assistance of the ethyl alcohol, whereafter the tobacco is heated and the n-pentane and ethyl alcohol acts as a propellant to expand the tobacco.

17 Claims, 2 Drawing Sheets

TOBACCO EXPANSION METHOD

BACKGROUND OF THE INVENTION

1. Field Of The Invention

This invention relates to a method for expanding the volume of tobacco by first adsorbing volatile substances thereon followed by condensation and absorption to substantially fill the mesoporous spaces thereof, thus allowing diffusion into the closed cellular spaces to provide a propellant, and subsequently heating the diffused propellant to expand the tobacco.

2. Description of the Prior Art

The reconstitution of dried tobacco products has been long practiced in the tobacco industry. In U.S. Pat. No. 3,144,871 it was recognized that tobacco could be partially restored to its predried volume by exposing it for a period of time to organic solvent vapors and subsequently allowing the solvent to evaporate. U.S. Pat. Nos. 3,524,451 and 3,534,452 taught the impregnation with liquid solvents under pressure followed by expansion in a high temperature gas stream, resulting in the doubling of the volume of the tobacco. As an alternative to impregnation with liquids or vapors, tobacco can be expanded with gases, as recognized in U.S. Pat. No. 1,789,435 or by means of solid compounds which decompose to form gases such as in U.S. Pat. No. 3,771,533.

The initial developments in the tobacco expansion process were performed in relatively unsophisticated laboratory apparatus or, on a commercial scale, with equipment described as readily available or easily modified by processes generally simple and straightforward. Improvements were obtained by the employment of volumes or weights of impregnating materials equal to that of the tobacco and resorting to extremes of process temperatures and pressures. These processes have subsequently been the subject of extensive study and refinement over the intervening years, with increases in performance and economy. Such developments have resulted in economic advantages in volume but at substantial increases in costs and with considerable detriment to tobacco quality, such that the quantity of expanded tobacco utilized has not exceeded 10–30% in products due to a combination of economic and organoleptic limitations. Most recently, the use of chlorofluorocarbons, which forms the basis of the certain prior processes, has been banned and commercial practice is now centered on processes which employ $CO_2$.

Former expansion processes are no longer ecologically acceptable and most existing processes are capital and energy intensive, destructive of the organoleptically and chemically desirable tobacco properties and add an ecological burden to the environment. Beyond simple economics, an additional and growing incentive for minimum weight tobacco products is the "ignition propensity" of cigarettes which is a cause of great concern to both the manufacturer and consumer.

OBJECTIVES OF THE INVENTION

Thus, with the aforesaid disadvantages and problems associated with prior art tobacco expansion methods, it is a specific object of the present invention to provide an expansion process to utilize tobaccos of any type, condition, or age and to bring such tobaccos to full organoleptic maturity for subsequent uses.

It is also an objective of the present invention to produce an acceptable tobacco product having a usual burn rate such as a cigarette with a minimum of tobacco weight.

It is in another objective of the present invention to provide a tobacco expansion process with minimum physical manipulation and handling of the tobacco.

It is still another objective of the present invention to utilize a minimum of an expanding chemical agent to maintain desirable taste properties.

It is another objective of the present invention to provide a process which is relatively inexpensive to perform.

It is another objective of the present invention to provide a process which does not create an ecological burden.

Another objective of the invention is to provide a process in which the tobacco is first sprayed with a humectant solution to adjust the volatile content of the tobacco to approximately 22% by weight.

It is also an objective of the present invention to utilize a process in which ethyl alcohol is supplied to the tobacco at a pressure up to 70 millimeters (Hg) absolute to prevent an azeotropic water-alcohol mixture from contacting the tobacco, and a hydrocarbon added subsequently which acts as a propellant in the expansion process.

Various other objectives and advantages of the invention will become apparent to those skilled in the art from the complete description as set forth below.

SUMMARY OF THE INVENTION

The aforesaid and other objectives are realized by treating tobacco with humectant solutions containing glycerine, propylene glycol or other compounds to adjust the resident liquids of tobacco to a weight of approximately 14–24% of the tobacco weight. Tobacco as treated can be of practically any condition or age which has been previously cured as is standard in the industry. The tobacco moistened with the humectant solutions as described is then placed in a sealed chamber such as a conventional vacuum chamber and the chamber is then evacuated by a vacuum source such as a pump to a pressure of about 10 mm(Hg) absolute. This evacuation vaporizes and removes a portion of the resident liquids which have been added to condition the tobacco. Once the low pressure as described is reached, the chamber is isolated from the vacuum source and ethyl alcohol is then allowed to pass into the chamber as the pressure therein rises. The pressure is controlled so it does not exceed 70 mm(Hg) absolute to prevent a water-alcohol azeotrope from forming. Ethyl alcohol is added to increase the solubility of the hydrocarbon which is subsequently added to expand the tobacco. The ethyl alcohol source is then isolated from the chamber and an aliphatic hydrocarbon is allowed to enter the chamber until atmospheric pressure is restored. The aliphatic hydrocarbon acts as a propellant in the expansion process and is given a period of time to diffuse into the cellular structure of the tobacco. Once the diffusion time has elapsed, the tobacco is removed from the sealed chamber and placed in an oven, on a hot surface or some other heating means whereby heat is applied to raise the tobacco temperature to 130°–140° F. to expand the tobacco which will then expand in volume to about 1.6–1.7 of its preprocessed volume. The tobacco can then be made into cigarettes or other products without the need of blending with other tobaccos to maintain a suitable burn rate.

DETAILED DESCRIPTION AND OPERATION OF THE PREFERRED EMBODIMENT OF THE INVENTION

Figures 1, 2:
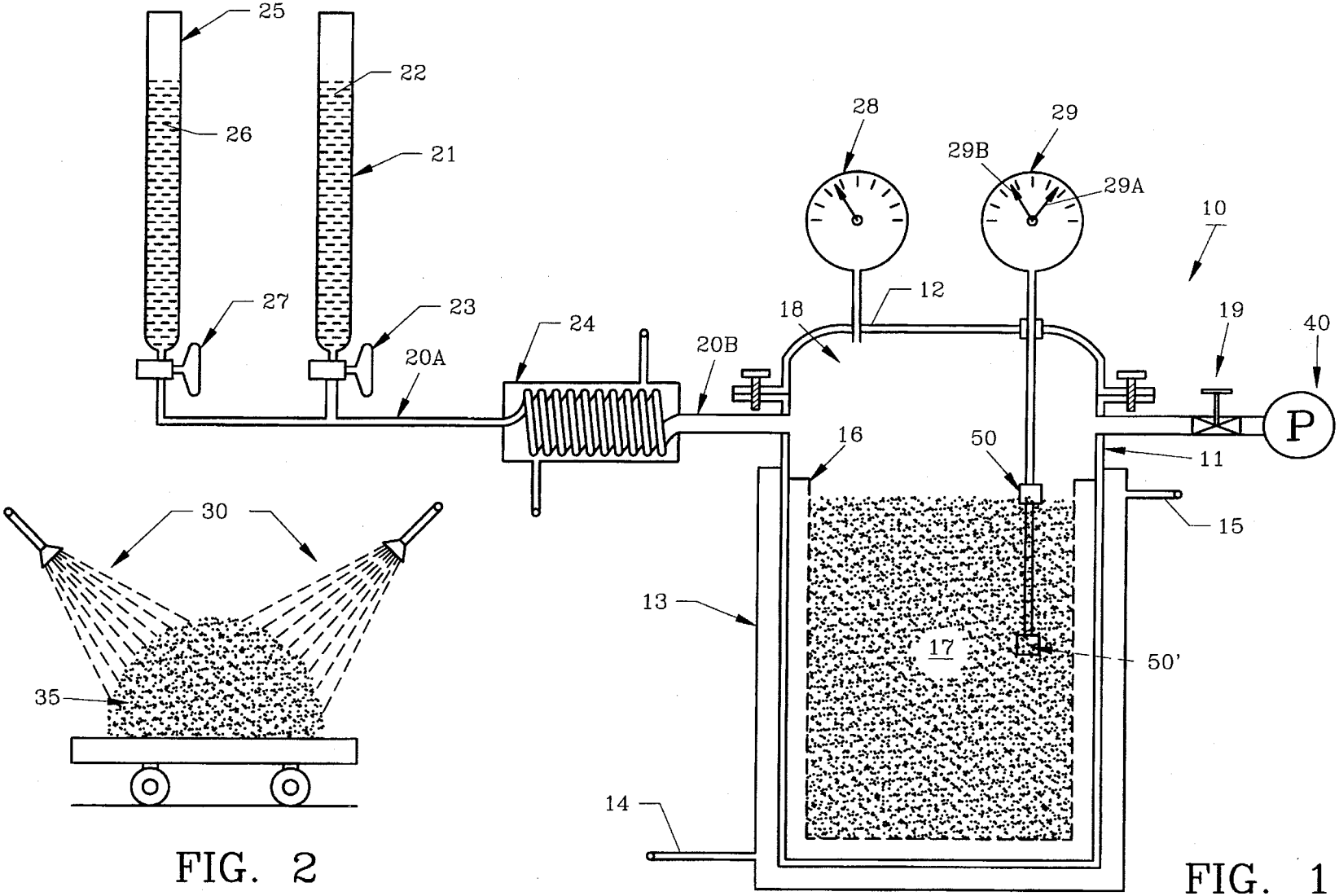
FIG. 1 illustrates pressure vessel equipment as used in the method of the invention herein described.
FIG. 2 demonstrates tobacco being sprayed with a humectant solution.

For a better understanding of the invention and its preferred method, turning now to the drawings, FIG. 1 shows pressure vessel 10 having a housing 11, a removable lid 12, and a temperature regulating jacket 13. Inlet 14 will allow a heated fluid, hot air or the like into jacket 13 and outlet 15 will allow cooled air or fluid to pass therefrom. Within housing 11, perforated container 16 is seen which contains a charge of tobacco 17. As would be understood, tobacco 17 is processed tobacco which has been cured and cut into suitable widths, such as 32–40 cuts per inch, as is standard in the industry for cigarettes or for other tobacco products. Tobacco of various conditions, types, or ages can be so treated with excellent results.

As further shown in FIG. 1, housing 11 encloses chamber 18 which can be pressurized or evacuated as required through valve 19 which is connected to a suitable pump (40). Fluids such as liquids or gases can be directed into chamber 18 through inlet conduit 20 which is joined to heat exchanger 24 for vaporizing fluids passing therethrough as needed. Joined to heat exchanger 24 is an alcohol source in the form of reservoir 21 which contains ethyl alcohol 22. Valve 23 can be used to regulate the flow of ethyl alcohol into inlet 20A, through vaporizer heat exchanger 24 and then through gas inlet conduit 20B. Reservoir 25 serves as a hydrocarbon source for hydrocarbon 26 which can likewise be directed through valve 27 to fluid inlet conduit 20A and into chamber 18 as required. Heat exchanger 24 raises the temperature of ethyl alcohol 22 and pentane 26 and vaporizes them for passage into conduit 20B and chamber 18. Pressure gauge 28 shows the pressure within chamber 18 and temperature gauge 29 demonstrates the internal temperature of chamber 18 and the tobacco temperature as needed in processing. Temperature sensor 50 determines the surface temperature of the tobacco 17 as seen by needle 29A, whereas sensor 50' senses the internal tobacco temperature as shown by needle 29B.

The preferred method for expanding tobacco for cigarettes or other products consists of first moistening a quantity of tobacco which has been conventionally cured and processed (including shredding) as seen in FIG. 2. Processed tobacco 35 has been cut to desired widths, as is standard in the industry, and is moistened by spraying with a humectant solution 30 such as glycerine, propylene glycol, 1–3 butylene glycol or other humectants and includes perhaps sugars. The exact formulation of the humectant solution will depend on the tobaccos employed and the specific end uses and tastes desired. The humectant solution used for moistening will increase the resident liquids of the tobacco to a weight of approximately 14–24% of the total weight. Next, the moistened tobacco is placed in a sealed chamber such as chamber 18 of pressure vessel 10. As illustrated in FIG. 1, container 16 within pressure vessel 10 is porous to allow fluid flow therethrough. Lid 12 is releasably sealed on housing 11 and a vacuum applied by pump 40 until the pressure reaches approximately 10 mm (Hg) absolute. This decrease in pressure boils away a portion of the moisture which was added to the tobacco and a portion of the resident liquids present in the tobacco which were added for flavor and conditioning purposes. Next, ethyl alcohol vapor is allowed to enter chamber 18 after chamber 18 has been isolated from the vacuum source for adsorption of alcohol vapor on tobacco 17 which passes therein through open valve 23 on reservoir 21. Pressure gauge 28 is carefully monitored to ensure that the pressure does not exceed 70 mm(Hg) absolute. By allowing the pressure to remain at 70 mm or below, there is no azeotropic formation between ethyl alcohol 21 and water that may be present in chamber 18 or associated with tobacco 17. Azeotropic formations of ethyl alcohol and water tend to lessen the later diffusion of hydrocarbon 26 into the tobacco and prevent or minimize the subsequent expansion when heat is applied. The amount of ethyl alcohol delivered to tobacco 17 is approximately 1% by weight of the tobacco. Next, the vapor of the preferred aliphatic hydrocarbon, n-pentane, is directed into chamber 18, such as from reservoir 25 shown in FIG. 1. The n-pentane is allowed to expand into chamber 18 until atmospheric pressure in chamber 18 is achieved. N-pentane and the previously applied humectants are utilized to penetrate into tobacco 17 with the assistance of ethyl alcohol 22 which acts as a penetrant assistant for the n-pentane. If the azeotropic alcohol-water form is present, proper diffusion of the n-pentane into the tobacco does not occur and the desired expansion of the tobacco upon heating is lessened. The amount of n-pentane 26 delivered to chamber 18 is approximately 8% of the weight of the tobacco present.

As would be understood in an alternate process, n-pentane can be added to tobacco 17 at a higher pressure, higher than atmospheric pressure, if additional n-pentane condensation and additional expansion of the tobacco is needed. Alternate embodiments of the invention may also utilize isopentane, neopentane or a mixture of pentanes as are commercially available. However, it has been found that by restoring chamber 18 to atmospheric pressure with n-pentane in the preferred process, an expansion factor of about 1.6–1.7 of the tobacco in volume is achieved, which is satisfactory for the purposes intended and economies desired.

After n-pentane has adsorbed onto tobacco 17, condensation on the tobacco and filling of the tobacco pores by the n-pentane will occur. It has been found that diffusion into the closed cellular spaces of the tobacco may take from one half hour to two hours but to insure thorough diffusion by the n-pentane and alcohol, longer periods of time may be used. Experiments have shown that time periods of between two and forty-eight hours, and even extended periods of time, have not proved to be detrimental to the tobacco so processed, although sixteen hours has been determined to be the preferred time for complete diffusion of n-pentane and ethyl alcohol and herein described.

After the diffusion steps are completed as discussed, tobacco 17 is then removed from chamber 18 and is expanded by conventional means such as uniformly heating by radiation, convection, conduction or combinations thereof. The tobacco temperature can be raised principally by conduction and the temperature should not exceed 140° F. The preferred method of heating the tobacco to expand it consists of placing the tobacco on a hot surface such as in the center of a wok-like device while stirring with a circular motion. The tobacco will reach a final overall temperature of 130°–140° F. and will require approximately one minute for an expansion factor of 1.6–1.7 times the original volume. The tobacco can also be expanded by heating it in a stream of hot gas or with superheated steam.

The tobacco so processed can be used in the manufacture of cigarettes without the need of blending with non-expanded tobacco to control the burn rate. The burn rate of the tobacco as processed generally retains the burn characteristics of non-expanded tobacco while reducing the quantity needed to form a firm cigarette. As an example, the tobacco was removed from cigarettes of an international brand and replaced by an equal weight of comparable tobacco expanded by the method of the invention. Comparison of static burn times of conditioned sample and control cigarettes yielded an increase of 13.9% in burn time for the sample.

Figure 3:
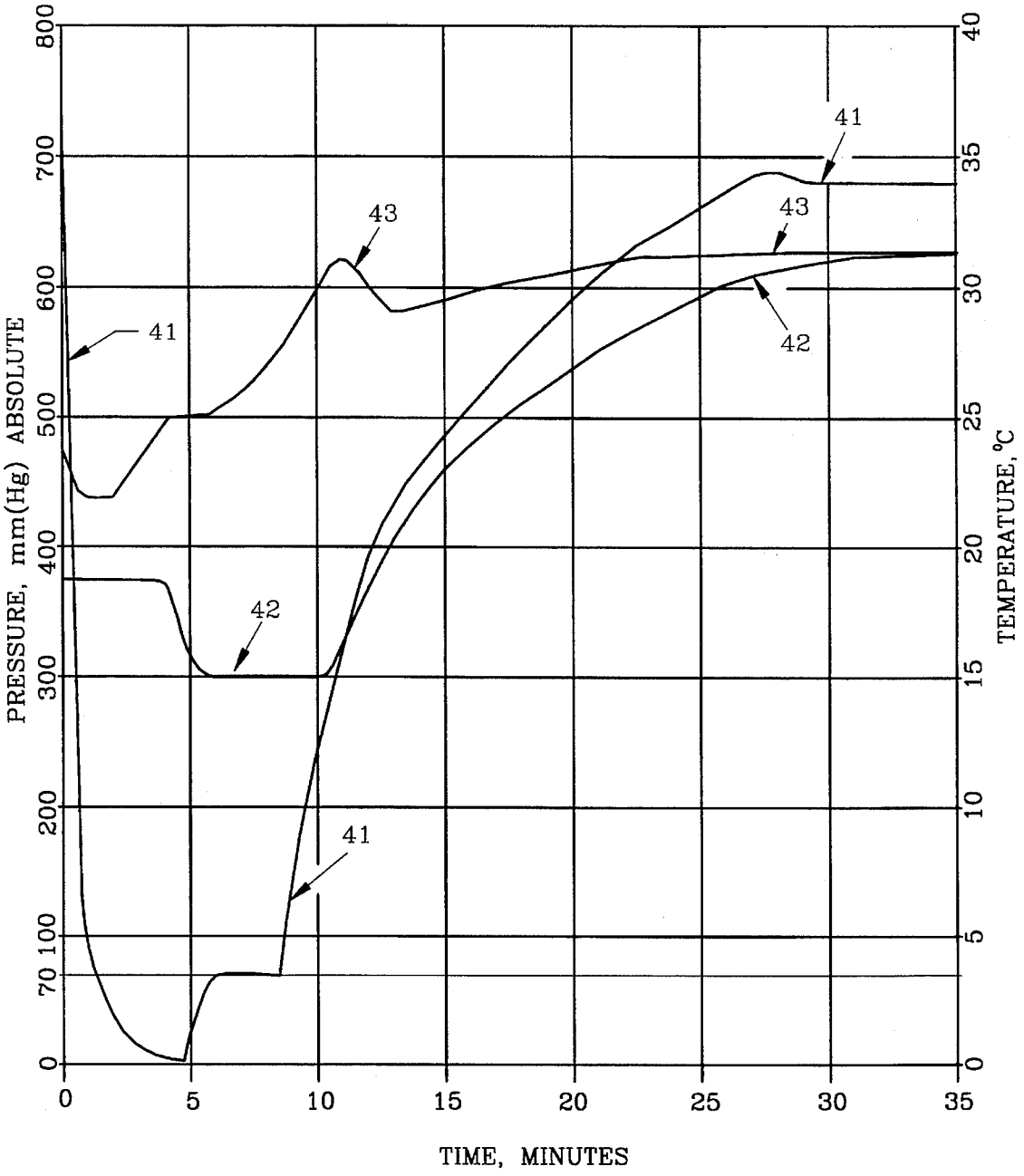
FIG. 3 is a graph with curves of the vessel pressure, and temperatures of the tobacco as processed herein.

As seen in FIG. 3, a graph of the temperature and pressure of the preferred method depicts the addition of the vapor of the ethyl alcohol 21 and hydrocarbon 26 consisting of n-pentane to tobacco 17. Curve 43 illustrates the surface temperature of the tobacco, curve 41 chamber 18 pressure, and curve 42 the overall tobacco 17 temperature as plotted against time in minutes. During approximate minutes 0–5, chamber 18 pressure is rapidly reduced wherein a portion of the resident liquids and/or humectants are vaporized and removed from chamber 18. At about 5–9 minutes, the addition of ethyl alcohol raises chamber 18 pressure to a maximum of 70 mm(Hg) to prevent a water-ethyl alcohol azeotrope from forming. From about 9–28 minutes n-pentane is added until atmospheric pressure is restored to chamber 18 whereby this pressure is sustained to allow thorough diffusion of the n-pentane into tobacco 17, as the temperature of the mass equilibrates.

Various other alcohols and hydrocarbons may be used by those skilled in the art and the descriptions and illustrations herein are for explanatory purposes and are not intended to limit the scope of the appended claims.

We claim:

1. A method of expanding tobacco comprising the steps of:

(a) placing tobacco having a plurality of resident liquids in a vacuum chamber;

(b) depressurizing the chamber to effect vaporization of said resident liquids;

(c) partially repressurizing the chamber with ethyl alcohol vapor while maintaining a low chamber pressure to prevent a water-alcohol alcohol azeotrope from forming;

(d) further repressurizing the chamber with a hydrocarbon vapor until atmospheric pressure is achieved;

(e) maintaining atmospheric pressure in the chamber to allow diffusion of the hydrocarbon into the tobacco, and (f) thereafter heating the tobacco to expand the same.

2. The method in claim 1 wherein depressurizing the chamber to effect vaporization comprises depressurizing the chamber to about 10 mm(Hg) absolute.

3. The method of claim 1 wherein the step of heating the tobacco to expand the same includes the step of heating the tobacco by thermal conduction.

4. The method in claim 3 wherein heating the tobacco to expand the same includes the step of heating the tobacco by contact with a surface heating element.

5. The method in claim 1 wherein the heating of said tobacco to expand the same includes the heating of the tobacco to a maximum temperature of 130°–140° F.

6. The method of claim 1 wherein partially repressurizing the chamber with ethyl alcohol vapor comprises maintaining a chamber pressure below 70 mm(Hg) absolute.

7. The method of claim 1 wherein the step of further repressurizing the chamber comprises repressurizing the chamber with vaporized pentane.

8. The method of claim 7 wherein repressurizing the chamber with pentane comprises repressurizing the chamber with vaporized n-pentane.

9. A method of expanding tobacco having resident liquids, comprising the steps of:

a. moistening the tobacco with a humectant solution to adjust the resident liquids weight of the tobacco to approximately 14–24%;

b. placing the moistened tobacco in a sealed chamber;

c. evacuating the chamber to about 10 mm (Hg) absolute:

d. placing the chamber in communication with a source of ethyl alcohol until the pressure of the chamber reaches no greater than 70 mm (Hg) absolute;

e. isolating the chamber from the ethyl alcohol source;

f. placing the chamber in communication with a hydrocarbon source until the chamber is restored to atmospheric pressure; and g. thereafter heating the tobacco to expand the same.

10. The method of claim 9 wherein moistening the tobacco with a humectant solution comprises spraying the tobacco with a solution containing glycerin.

11. The method of claim 9 wherein moistening the tobacco comprises spraying the tobacco with a propylene glycol solution.

12. The method of claim 9 wherein moistening the tobacco comprises spraying the tobacco with a butylene glycol solution.

13. The method of claim 9 wherein the hydrocarbon source comprises a source of n-pentane.

14. The method of claim 9 wherein the resident liquids are adjusted to 22%.

15. The method of claim 9 and including the step of maintaining the tobacco in the restored atmospheric pressure for at least two hours before heating the tobacco.

16. The method of claim 9 whereas heating the tobacco comprises heating it by a stream of hot gas.

17. The method of claim 16 wherein heating the tobacco with a hot gas comprises heating it with superheated steam.

* * * * *